US009944092B2

(12) United States Patent
Nagasawa

(10) Patent No.: US 9,944,092 B2
(45) Date of Patent: Apr. 17, 2018

(54) POST-PROCESSING AGENT APPLICATION CONTROL DEVICE, IMAGE FORMING SYSTEM, POST-PROCESSING AGENT APPLICATION CONTROL METHOD AND RECORDING MEDIUM

(71) Applicant: Satoru Nagasawa, Kanagawa (JP)

(72) Inventor: Satoru Nagasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/404,938

(22) Filed: Jan. 12, 2017

(65) Prior Publication Data

US 2017/0203583 A1 Jul. 20, 2017

(30) Foreign Application Priority Data

Jan. 15, 2016 (JP) ..... 2016-006538
Nov. 21, 2016 (JP) ..... 2016-226075

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
USPC ..... 347/100, 101, 12
See application file for complete search history.

(56) References Cited

U.S. PATENT DOCUMENTS 6,254,230 B1 * 7/2001 Wen ..... B41J 2/01 347/101
8,814,342 B2 * 8/2014 Usuda ..... B41J 2/2117 347/101
9,669,639 B2 6/2017 Nagasawa et al.
2007/0013759 A1 * 1/2007 Kadomatsu ..... B41J 2/2114 347/102
2013/0293617 A1 11/2013 Suzuki et al.
2013/0293629 A1 11/2013 Niino et al.
(Continued)

FOREIGN PATENT DOCUMENTS

JP 2006-168107 6/2006
JP 2014-176997 9/2014

OTHER PUBLICATIONS

U.S. Appl. No. 15/232,957, filed Aug. 10, 2016.

*Primary Examiner* — Lam Nguyen
(74) *Attorney, Agent, or Firm* — Duft Bornsen & Fettig LLP

(57) ABSTRACT

A post-processing agent application control device includes: a first post-processing agent application amount determination unit configured to determine an amount of a post-processing agent to be applied to an image formed on a recording medium; a first glossiness determination unit configured to determine a first glossiness that is a glossiness of a non-image area of the recording medium in a case where the determined amount of the post-processing agent is applied to the non-image area; and a second post-processing agent application amount determination unit configured to, if glossiness difference between the determined first glossiness and a second glossiness that is a glossiness of the non-image area of the recording medium is applied is larger than the predetermined value, change an amount of the post-processing agent to be applied, in a stepwise manner from an image area to the non-image area.

9 Claims, 15 Drawing Sheets

(56) References Cited

U.S. PATENT DOCUMENTS

| | | | |
|---|---|---|---|
| 2013/0293645 | A1 | 11/2013 | Yasu et al. |
| 2014/0132658 | A1 | 5/2014 | Suzuki et al. |
| 2014/0253651 | A1 | 9/2014 | Akiyama et al. |
| 2015/0056423 | A1 | 2/2015 | Yasu et al. |
| 2016/0136975 | A1 | 5/2016 | Yasu et al. |

* cited by examiner

FIG.11

| RECORDING-MEDIUM TYPE | RESOLUTION | PRINTING SPEED | TOTAL AMOUNT REGULATORY VALUE | DROPLET CONFIGURATION | INK TYPE | AMOUNT OF POST-PROCESSING LIQUID TO BE APPLIED |
|---|---|---|---|---|---|---|
| $\alpha_1$ | $\beta_1$ | $\gamma_1$ | $\delta_1$ | $\varepsilon_1$ | $\zeta_1$ | $\eta_1$ |
| $\alpha_2$ | $\beta_2$ | $\gamma_2$ | $\delta_2$ | $\varepsilon_2$ | $\zeta_2$ | $\eta_2$ |
| $\alpha_3$ | $\beta_3$ | $\gamma_3$ | $\delta_3$ | $\varepsilon_3$ | $\zeta_3$ | $\eta_3$ |
| ⋮ | ⋮ | ⋮ | ⋮ | ⋮ | ⋮ | ⋮ |

FIG.12

RECORDING-MEDIUM TYPE: $\alpha_1$

| AMOUNT OF POST-PROCESSING LIQUID TO BE APPLIED | GLOSSINESS OF UNPRINTED AREA |
|---|---|
| $\eta_1$ | $\theta_1$ |
| $\eta_2$ | $\theta_2$ |
| $\eta_3$ | $\theta_3$ |
| ⋮ | ⋮ |

RECORDING-MEDIUM TYPE: $\alpha_2$

| AMOUNT OF POST-PROCESSING LIQUID TO BE APPLIED | GLOSSINESS OF UNPRINTED AREA |
|---|---|
| $\eta_1$ | $\iota_1$ |
| $\eta_2$ | $\iota_2$ |
| $\eta_3$ | $\iota_3$ |
| ⋮ | ⋮ |

RECORDING-MEDIUM TYPE: $\alpha_3$

| AMOUNT OF POST-PROCESSING LIQUID TO BE APPLIED | GLOSSINESS OF UNPRINTED AREA |
|---|---|
| $\eta_1$ | $\kappa_1$ |
| $\eta_2$ | $\kappa_2$ |
| $\eta_3$ | $\kappa_3$ |
| ⋮ | ⋮ |

FIG.14

| RECORDING-MEDIUM TYPE | NATURAL GLOSSINESS |
|---|---|
| $\alpha_1$ | $\lambda_1$ |
| $\alpha_2$ | $\lambda_2$ |
| $\alpha_3$ | $\lambda_3$ |
| ⋮ | ⋮ |

FIG.15

X=10

| NATURAL GLOSSINESS | GLOSSINESS OF UNPRINTED AREA | APPLICATION AREA 2 | APPLICATION AREA 3 | APPLICATION AREA 4 | APPLICATION AREA 5 | APPLICATION AREA 6 |
|---|---|---|---|---|---|---|
| 15 | 30 | 20 | – | – | – | – |
| 60 | 40 | 50 | – | – | – | – |
| 5 | 35 | 25 | 15 | – | – | – |
| 10 | 70 | 60 | 50 | 40 | 30 | 20 |
| ⋮ | ⋮ | ⋮ | ⋮ | ⋮ | ⋮ | ⋮ |

POST-PROCESSING AGENT APPLICATION CONTROL DEVICE, IMAGE FORMING SYSTEM, POST-PROCESSING AGENT APPLICATION CONTROL METHOD AND RECORDING MEDIUM

CROSS-REFERENCE TO RELATED APPLICATIONS

The present application claims priority under 35 U.S.C. § 119 to Japanese Patent Application No. 2016-006538, filed Jan. 15, 2016 and Japanese Patent Application No. 2016-226075, filed Nov. 21, 2016. The contents of which are incorporated herein by reference in their entirety.

BACKGROUND OF THE INVENTION

1. Field of the Invention

The embodiments discussed herein are directed to a post-processing agent application control device, an image forming system, a post-processing agent application control method, and a recording medium.

2. Description of the Related Art

In recent years, image forming apparatuses that are used to output computerized information or to copy originals have been necessary devices. Among those image forming apparatuses, image forming apparatuses configured to apply a post-processing agent to the printed surface of a printed matter after printing are known.

With respect to such image forming apparatuses, it is necessary to reduce the amount of a post-processing gent to be applied in order to reduce the cost per page (CPP) and increase the dryness. A technique of applying a post-processing agent to only a printed area is already known (see Japanese Unexamined Patent Application Publication No. 2014-176997).

In the case where the post-processing agent is applied to only the printed area as with the image forming apparatus disclosed in Japanese Unexamined Patent Application Publication No. 2014-176997, the post-processing agent may be applied to a shifted position from the printed area depending on the printing accuracy, the accuracy in applying the post-processing agent, and the accuracy in conveying a recording medium. In other words, the post-processing agent may be not necessarily applied to an area to which the post-processing agent is required to be applied. In order to prevent this, it is necessary, when the technique disclosed in Japanese Unexamined Patent Application Publication No. 2014-176997 is used, to apply the post-processing agent to an area wider than the printed area in consideration of the accuracy listed above.

When the post-processing agent is applied to an area wider than the printed area, however, there is a problem in that the post-processing agent is partly applied also to an area other than the printed area (hereinafter, referred to as an "unprinted area") and accordingly a difference in glossiness occurs at the boundary between the unprinted area to which the post-processing agent is applied (hereinafter, "application area") and the unprinted area to which the post-processing agent is not applied (hereinafter, "non-application area).

SUMMARY OF THE INVENTION

According to one aspect of the present invention, a post-processing agent application control device is configured to control application of a post-processing agent to a recording medium by a post-processing agent application device. The post-processing agent application control device includes a first post-processing agent, a first glossiness determination unit, a comparison unit, and a second post-processing agent application amount determination unit. The first post-processing agent application amount determination unit is configured to determine an amount of the post-processing agent to be applied to an image formed on the recording medium. The first glossiness determination unit is configured to determine a first glossiness that is a glossiness of a non-image area of the recording medium in a case where the determined amount of the post-processing agent is applied to the non-image area. The comparison unit is configured to compare a glossiness difference between the determined first glossiness and a second glossiness that is a glossiness of the non-image area of the recording medium is applied, with a predetermined value. The second post-processing agent application amount determination unit is configured to, if the glossiness difference is larger than the predetermined value, change an amount of the post-processing agent to be applied, in a stepwise manner from an image area to the non-image area.

BRIEF DESCRIPTION OF THE DRAWINGS

FIG. 11 is a diagram of an exemplary post-processing liquid application amount determination table according to the embodiment of the invention;

FIG. 12 is a diagram of an exemplary unprinted-area glossiness determination table according to the embodiment of the invention;

FIG. 14 is a diagram of an exemplary natural glossiness determination table according to the embodiment of the invention;

FIG. 15 is a diagram of an exemplary application area glossiness determination table according to the embodiment of the invention;

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
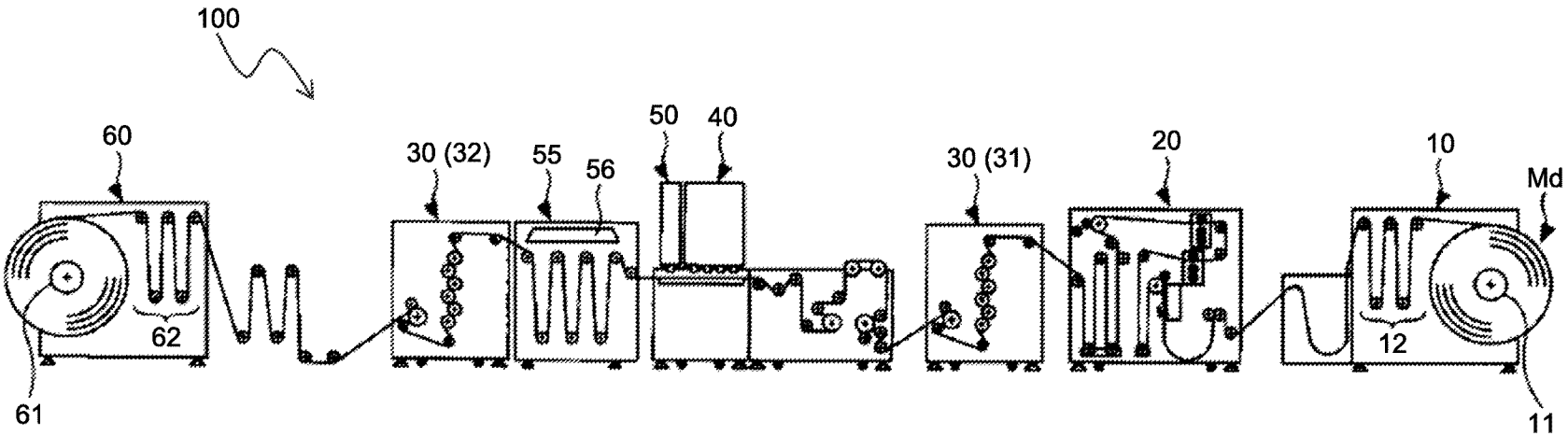
FIG. 1 is an overview (schematic side view) of an exemplary image forming apparatus according to an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to reduce the difference in glossiness at the boundary between the area to which the post-processing agent is applied and the area to which the post-processing agent is not applied.

An image forming apparatus 100 according to the embodiment of the invention will be described with reference to FIGS. 1 to 3. The image forming apparatus 100 includes ejection heads corresponding to four colors of black (K), cyan (C), magenta (M) and yellow (Y). Image forming apparatuses to which the invention is applicable are not limited to those including these ejection heads. In other words, image forming apparatuses to which the invention is applicable include an image forming apparatus that further includes ejection heads corresponding to green (G), red (R) and light cyan (LC) and/or another color (other colors) and an image forming apparatus that includes an ejection head corresponding to only black (K). In the following descriptions, "K, C, M and Y" used as indices of reference numerals are used to represent the colors of black, cyan, magenta and yellow, respectively.

In the embodiment, a continuous sheet of the roll of paper (hereinafter, "paper-roll sheet Md") is used as a recording medium; however, recording media on which the image forming apparatus can form images are not limited to paper-roll sheets. In other words, recording media on which the image forming apparatus can form images may be cut paper sheets. Recording media on which the image forming apparatus can form images include normal paper sheets, high-quality paper sheets, thin paper sheets, thick paper sheets, recording paper sheets and paper-roll sheets and further include OHP sheets, synthetic resin films, metal thin films and sheet-type recording media each having a certain surface on which an image can be formed with, for example, ink.

The paper-roll sheet is a continuous sheet of paper longer than a standard size. The paper-roll sheet includes a continuous sheet of paper with perforations along which the paper sheet can be cut and that are formed at given intervals and a continuous sheet of paper without perforations. When ledger sheets are formed using a continuous paper sheet on which perforations are formed, a page of the ledger sheets is formed of the area between sets of perforations.

1. Configuration of Image Forming Apparatus 100

As illustrated in FIG. 1, the image forming apparatus 100 according to the embodiment of the invention includes an conveying-in unit 10, a pre-processing liquid application unit 20, a pre-processing liquid drying unit 31, an image forming unit 40, a post-processing liquid application unit 50 that includes a post-processing agent application device, an permeation unit 55, a post-processing liquid drying unit 32, and an conveying-out unit 60. The conveying-in unit 10 conveys the paper-roll sheet Md that is a recording medium into the image forming apparatus 100. The pre-processing liquid application unit 20 applies a pre-processing liquid to the paper-roll sheet Md conveyed into the image forming apparatus 100. The pre-processing liquid application unit 20 is a pre-processing unit that performs application of the pre-processing liquid to the paper-roll sheet Md as the pre-processing. The pre-processing liquid drying unit 31 that is a type of a drying unit 30 dries the paper-roll sheet Md having undergone the pre-processing. The image forming unit 40 forms an image on the surface of the paper-roll sheet Md on which the pre-processing liquid has been applied. The post-processing liquid application unit 50 applies a post-processing liquid that is a type of a post processing agent to the paper roll sheet Md with the image formed thereon. The post-processing liquid application unit 50 is a post-processing unit that performs application of the post processing liquid to the paper-roll sheet Md as the post processing. The permeation unit 55 causes droplets on the paper-roll sheet Md to permeate the paper roll sheet Md. The post-processing liquid drying unit 32 that is a type of the drying unit 30 dries the ink and the post-processing liquid on the paper-roll sheet Md. The conveying-out unit 60 rolls up the paper-roll sheet Md and conveys the paper-roll sheet Md out of the image forming apparatus 100. The image forming apparatus 100 further includes a control unit 70 that controls operations of the image forming apparatus 100 as described below.

The components of the image forming apparatus 100 according to the embodiment of the present invention will be described below. The image forming apparatus 100 may be configured not to include at least any one of the pre-processing liquid application unit 20, the drying unit 30 (the pre-processing liquid drying unit 31 and the post-processing liquid drying unit 32) and the permeation unit 55.

2. Configuration of Conveying-In Unit 10

The conveying-in unit 10 is a unit that conveys the paper-roll sheet Md into the pre-processing liquid application unit 20, etc. The conveying-in unit 10 includes, for example, a paper feeder 11 and multiple conveying rollers 12. The conveying-in unit 10 uses the conveying rollers 12, etc., to move the paper-roll sheet Md, which is rolled and held around a paper-feeding roll of the paper feeder 11, toward the pre-processing liquid application unit 20 that is arranged downstream in the direction in which the paper-roll sheet Md is conveyed.

3. Configuration of Pre-Processing Liquid Application Unit 20

The pre-processing liquid application unit 20 is a unit that performs processing on the paper-roll sheet Md before an image is formed. The pre-processing liquid application unit 20 is a unit that performs pre-processing using the pre-processing liquid on the surface of the paper roll M that is conveyed into the pre-processing liquid application unit 20 by the conveying-in unit 10.

The pre-processing according to the embodiment is processing of uniformly applying the pre-processing liquid having a function of solidifying the ink on the surface of the paper-roll sheet Md. The pre-processing allows the image forming apparatus 100 to effectively solidify the ink on the surface of the paper-roll sheet Md even when an image is formed on a paper-roll sheet Md other than a paper-roll sheet dedicated to the inkjet system.

4. Configuration of Pre-Processing Liquid Drying Unit 31

As illustrated in FIG. 1, the image forming apparatus 100 includes the drying unit 30 that includes the pre-processing liquid drying unit 31 that dries the paper-roll sheet Md having undergone the pre-processing performed by the pre-processing liquid application unit 20 and the post-processing liquid drying unit 32 that dries the paper-roll sheet Md having undergone the post-processing performed by the post-processing liquid application unit 50. The drying unit 30 is a unit that evaporates the moisture that is a solvent of the pre-processing liquid by, for example, heating the paper-roll sheet Md, thereby drying the paper-roll sheet Md.

The pre-processing liquid drying unit 31 includes multiple heat rollers. Each of the heat rollers is heated to, for example, 80° C. to 100° C. and is arranged such that each of the heat rollers makes contact with the back surface of the paper-roll sheet Md. A fan heater may be added to the pre-processing liquid drying unit 31.

5. Configuration of Image Forming Unit 40

The image forming unit 40 is a unit that forms an image on the paper-roll sheet Md. The image forming unit 40 ejects the ink on the paper-roll sheet Md dried by the pre-processing liquid drying unit 31 to form an image on the surface of the paper-roll sheet Md.

Figure 2A:
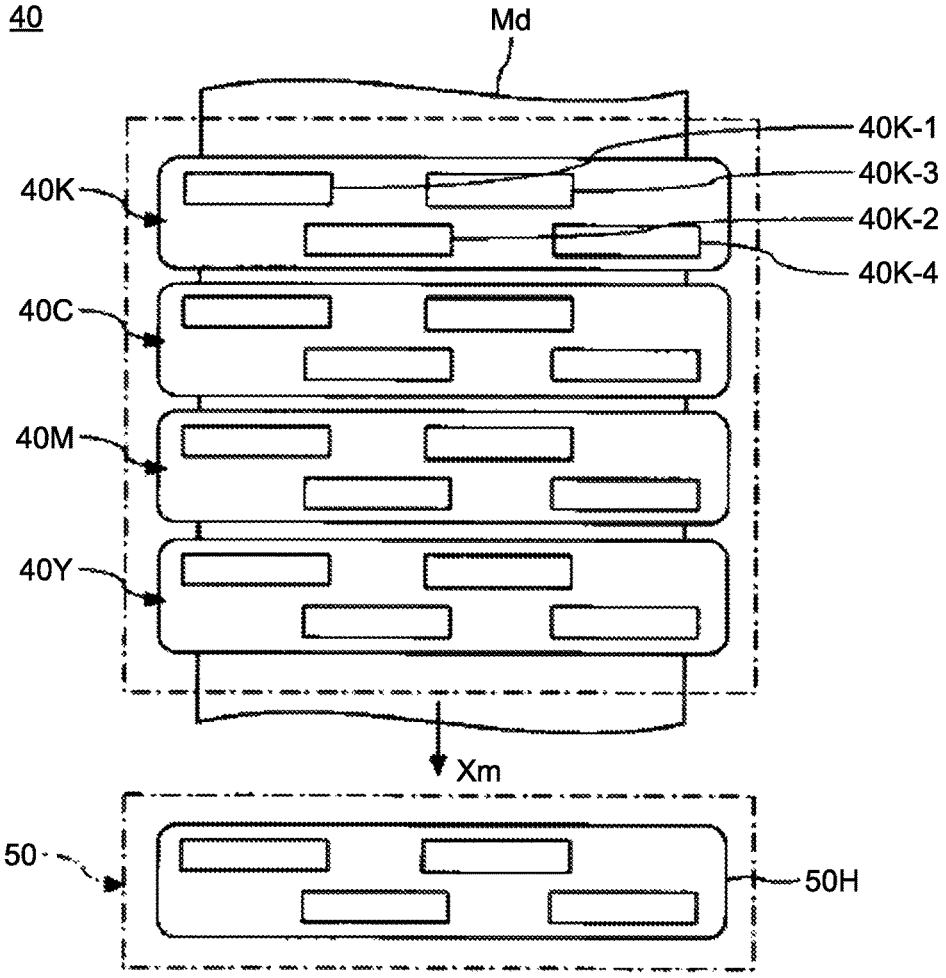
FIG. 2A is a schematic view of an exemplary configuration of an array of droplet ejection heads of an image forming unit and a post-processing liquid application unit according to the embodiment of the invention.
Figure 2B:
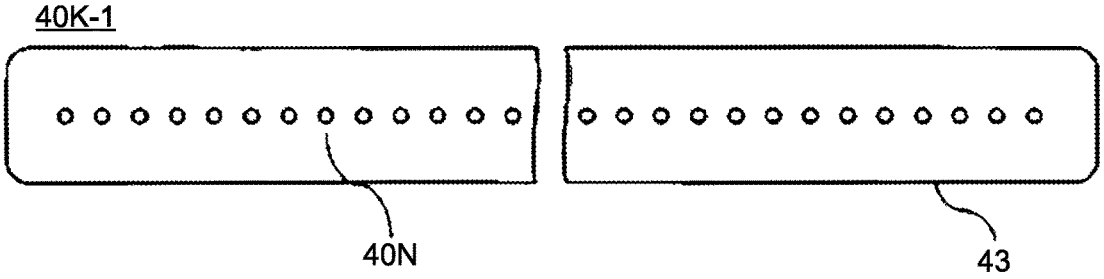
FIG. 2B is an enlarged view of a part of FIG. 2A.

An exemplary outer shape of the image forming unit 40 will be described with reference to FIG. 2. FIG. 2A is a schematic plane view of an exemplary entire configuration of the image forming unit 40 of the image forming apparatus 100 according to the embodiment of the invention. FIG. 2B is an enlarged plane view of an exemplary election head 40K corresponding to black (K) that is one of the components of the image forming unit 40.

As illustrated in FIG. 2A, the image forming unit 40 includes a full-line head. The full-lined head includes four ejection heads 40K, 40C, 40M and 40Y that correspond to black (K), cyan (C), magenta (M) and yellow (Y), respectively, and that are arranged from the upstream in a direction Xm in which the paper-roll sheet Md is conveyed.

The ejection head 40K corresponding to black (K) includes four head units 40K-1, 40K-2, 40K-3 and 40K-4 that are arranged in a zigzag manner in the direction orthogonal to the direction Xm in which the paper-roll sheet Md is conveyed. Accordingly, the image forming unit 40 is able to form an image over an image forming area of the paper-roll sheet Md in the width direction. In other words, the image forming unit 40 uses, as a printing area, the entire area in the direction orthogonal to the direction in which the paper-roll sheet Md is conveyed and forms an image on the printing area.

As illustrated in FIG. 2B, the head unit 40K-1 includes multiple nozzles 40N on the nozzle surface (the outer surface of a nozzle plate 43). The multiple nozzles 40N are ejection ports for ink that is a liquid and are areas referred to as printing nozzles. The nozzles 40N constitute the nozzle array including multiple nozzles that are arranged in a line in the longitudinal direction of the head unit 40K-1. The head unit 40K-1 employs a single-path inkjet system including a nozzle array in the main-scanning direction. The head unit 40K-1 may include multiple nozzle arrays.

Figure 3A:
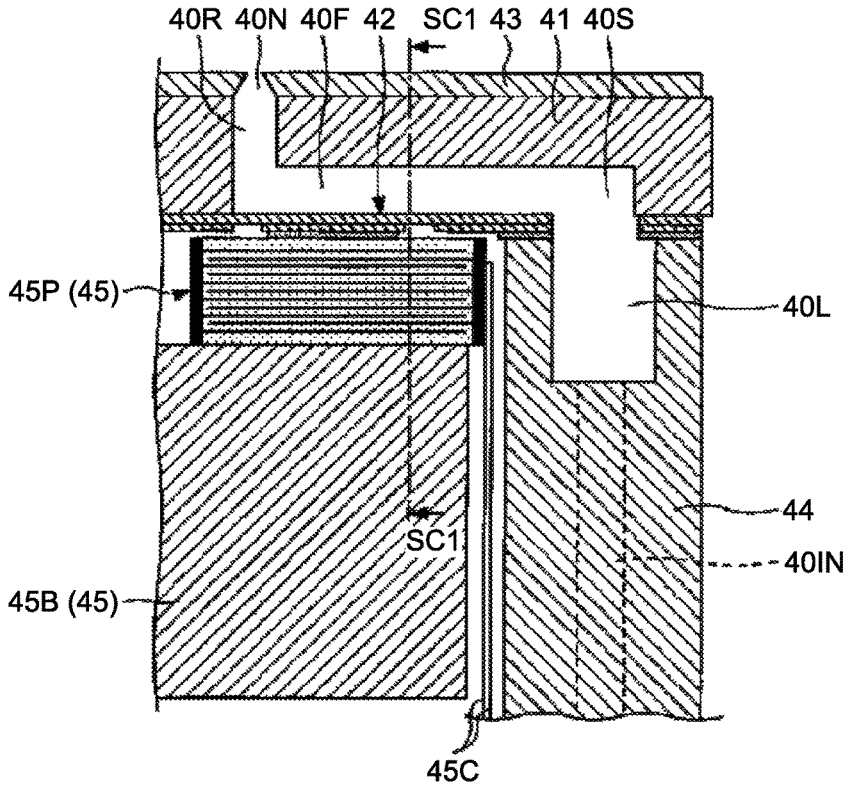
FIG. 3A is a bottom view for explaining a case where a line head is used as an exemplary image forming unit and an exemplary post-processing ejection unit of the image forming apparatus illustrated in FIG. 1.

The detailed configuration of the ejection head 40K of the image forming unit 40 will be described here. As illustrated in FIG. 3A, the ejection head 40K includes a flow-path plate 41 that forms a path for the ink to be ejected, an diaphragm 42 that is adhered to the bottom surface of the flow-path plate 41 (inner direction of the ejection head 40K), the nozzle plate 43 that is adhered to the upper surface of the flow-path plate 41 (outer direction of the ejection head 40K), and a frame member 44 that holds the periphery of the diaphragm 42. The ejection head 40K further includes a pressure generator 45 that is an actuator for deforming the diaphragm 42.

In the ejection head 40K according to the embodiment, the flow-path plate 41, the diaphragm 42 and the nozzle plate 43 are laminated to form a nozzle communication path 40R that is a flow path communicating with the nozzle 40N and a liquid chamber 40F. In the ejection head 40K, the frame member 44 is further laminated and accordingly an ink flow-in port 40S for supplying ink to the liquid chamber 40F and a common liquid chamber 40L that supplies ink to the liquid chamber 40F are formed.

In the frame member 44, a housing that stores the pressure generator, a concave area serving as the common liquid chamber 40L, and an ink supply port 40IN for supplying ink from the outside of the ejection head to the common liquid chamber 40L are formed.

The pressure generator 45 includes a piezoelectric element 45P that is an electromechanical transducer, a base substrate 45B to which the piezoelectric element 45P is fixed by adhesion, and a column arranged in the space between adjacent piezoelectric elements 45P. The pressure generator 45 further includes a FPC cable 45C for connecting the piezoelectric element 45P to a drive circuit.

Figure 3B:
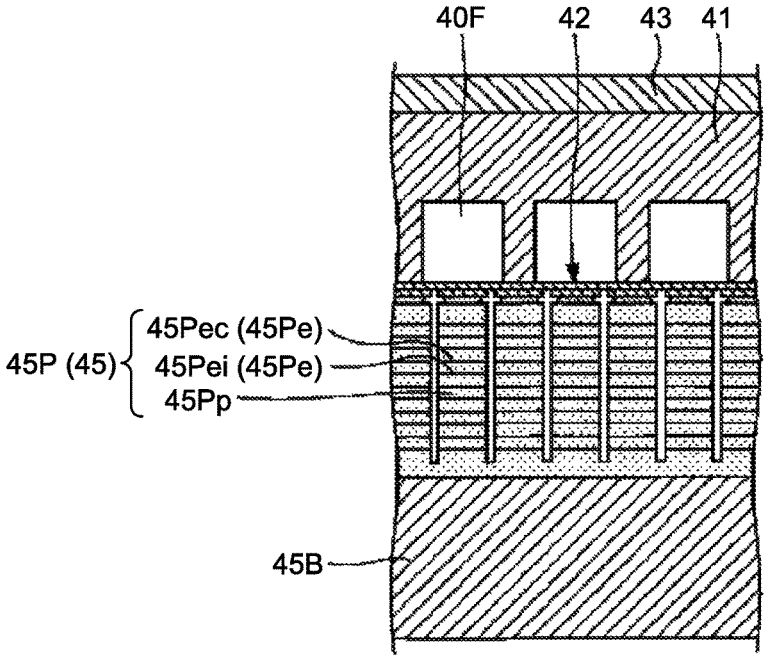
FIG. 3B is an enlarged view of FIG. 3A.

FIG. 3B is an enlarged diagram of a part of the piezoelectric element 45P. As illustrated in FIG. 3B, for the piezoelectric element 45P, a laminated piezoelectric element (PZT) in which a piezoelectric material 45Pp and an internal electrode 45Pe are laminated alternately. The internal electrode 45Pe includes multiple individual electrodes 45Pei and multiple common electrodes 45Pec. The internal electrode 45Pe is configured by connecting the individual electrode 45Pei or the common electrode 45Pec to the end surface of the piezoelectric material 45Pp alternately.

An operation of the ejection head 40K to eject the ink from the nozzles 40N (pull-push operation) will be specifically described below.

In the ejection head 40K, first of all, the voltage applied to the piezoelectric element 45P that the pressure generator 45 includes is reduced from the reference potential to cause the piezoelectric element 45P to shrink in its lamination direction. The shrink of the piezoelectric element 45P causes deflection of the diaphragm 42. The deflection of the diaphragm 42 increases the capacity of the liquid chamber 40F of the ejection head 40K. In other words, lowering the voltage applied to the piezoelectric element 45P from the reference potential increases the volume of the liquid chamber 40F. The series of operations causes the ink to flow from the common liquid chamber 40L into the liquid chamber 40F in the ejection head 40K.

The voltage applied to the piezoelectric element 45P of the ejection head 40K is then increased to a voltage above the reference potential to cause the the piezoelectric element 45P to extend in its lamination direction. The extension of the piezoelectric element 45P deforms the diaphragm 42 in the direction to the nozzle 40N. The deformation of the diaphragm 42 reduces the capacity of the liquid chamber 40F. In other words, increasing the voltage applied to the piezoelectric element 45P to a voltage above the reference potential reduces the volume of the liquid chamber 40F. The series of operations applies a pressure to the ink in the liquid chamber 40F in the ejection head 40K. The pressure applied to the ink in the ejection head 40K causes the ink to be ejected from the nozzles 40N.

The ejection head 40K then returns the voltage applied to the piezoelectric element 45P to the reference potential. Accordingly, the diaphragm 42 returns to the initial position and restored. In the ejection head 40K, the inner pressure of the liquid chamber 40F decreases due to the expansion of the liquid chamber 40F and accordingly the ink is supplied from the common liquid chamber 40L to the liquid chamber 40F and the liquid chamber 40F is filled with the ink. After the oscillation of the meniscus surface of the nozzles 40N attenuates and is stabilized, the ejection head 40K moves to an operation for the next ejection. The ejection head 40K repeats the operations described above.

As described above, using the pressure generator 45, the ejection head 40K causes deflection of the diaphragm 42, changes the capacity of the liquid chamber 40F, changes the pressure applied to the ink in the liquid chamber 40F, and accordingly ejects the ink from the nozzles 40N.

The method of driving the ejection head 40K to which the invention is applicable is not limited to the above example (pull-push operation). For example, the method of driving the ejection head 40K may be a pulling operation or a pushing operation that is performed by controlling the voltage (drive waveform) that is applied to the piezoelectric element 45P. Furthermore, for the pressure generator 45, a thermal type that heats the ink in the liquid chamber 40F using a heating resistor to generate bubbles or an electrostatic type in which a diaphragm and an electrode are arranged on the wall surfaces of the liquid chamber 40F such that the diaphragm and the electrode are opposed to each other and the diaphragm is deformed by the electrostatic force that is generated between the diaphragm and the electrode. Other ejection heads that are the ejection heads 40C, 40M and 40Y have the same configuration as the ejection head 40K corresponding to black (K). Thus, detailed descriptions thereof will be omitted.

In the above-described manner, the image forming apparatus 100 of the embodiment forms a black and white image or a full-color image over the image forming area using the image forming unit 40 (the four ejection heads 40K, 40C, 40M and 40Y) through the operation of conveying the paper-roll sheet Md once.

6. Configuration of Post-Processing Liquid Application Unit

The post-processing liquid application unit 50 is a unit that performs processing on the paper-roll sheet Md with an formed thereon. The post-processing liquid application unit 50 is a unit that performs the post-processing using the post-processing liquid on the surface of the paper-roll sheet Md with the image formed thereon by the image forming unit 40. As illustrated in FIG. 2A, the post-processing liquid application unit 50 is arranged on the downstream side with respect to the image forming unit 40 in the direction in which the paper-roll sheet Md is conveyed. In the post-processing liquid application unit 50, as in the case of the image forming unit 40, an ejection head 50H includes head units that are arranged in a zigzag manner in the direction orthogonal to the direction Xm in which the paper-roll sheet Md is conveyed.

The post-processing liquid application unit 50 controls the drive waveform that is input to the ejection head 50H to control the amount of the post-processing liquid. In other words, the image forming unit 40 uses, as the printing area, the entire area in the direction orthogonal to the direction in which the paper-roll sheet Md is conveyed and forms an image on the printing area. The post-processing liquid application unit 50 is able to eject the post-processing liquid over the image forming area of the paper-roll sheet Md in the width direction using the ejection head 50H. In other words, the post-processing liquid application unit 50 applies the post-processing liquid to the printing area that is the entire area in the direction orthogonal to the direction in which the paper-roll sheet Md is conveyed. The ejection head 50H has the same configuration as the ejection head 40K of the image forming unit 40 that is described with reference to FIGS. 2 and 3. The detailed configuration of the ejection head 50H will be omitted as it is possible to obtain descriptions thereof by properly reading the configuration of the ejection head 40K as the configuration of the ejection head 50H.

The post-processing according to the embodiment is processing of ejecting the post-processing liquid to the printing area on the paper-roll sheet Md and depositing the post-processing liquid. This post-processing makes it possible to prevent the ink from delaminating due to abrasion of the surface of the paper-roll sheet Md with the image formed thereon with another object, such as the other surface of the paper-roll sheet. In other words, the post-processing makes it possible to increase the rub resistance or the rubfastness of the printed image. The post-processing further makes it possible to increase the glossiness on the printed surface, preservation stability, etc. The preservation stability includes water resistance, light resistance, and gas resistance.

7. Configuration of Permeation Unit

The permeation unit 55 is a unit that permeates the solvent in the ink into the paper-roll sheet Md. The permeation unit 55 increases the distance in which the paper-roll sheet Md is conveyed to increase the time for permeation of the solvent. Furthermore, the heating unit 56 illustrated in FIG. 1 sets the temperature of the atmosphere in the permeation unit 55 at a temperature from 30° C. to 100° C. at which the moisture does not evaporate and heats the paper-roll sheet Md and the ink. Accordingly, the viscosity of the ink in the state of a solution containing the high-boiling-point solvent in the ink is lowered and the rate of permeation is increased.

8. Configuration of Post-Processing Liquid Drying Unit 32

As illustrated in FIG. 1, the post-processing liquid drying unit 32 includes multiple heat rollers. Each of the heat rollers is heated to, for example, a temperature from 80° C. to 100° C. and is arranged such that each of the heat rollers makes contact with the back surface of the paper-roll sheet Md. A fan heater may be added to the post-processing liquid drying unit 32. The post-processing liquid drying unit 32 is a unit that evaporates the moisture that is the solvent of the ink and the post processing liquid to dry the paper-roll sheet Md.

9. Configuration of Conveying-Out Unit 60

The conveying-out unit 60 is a unit that conveys the paper-roll sheet Md with the image formed thereon out of the image forming apparatus 100. As illustrated in FIG. 1, the conveying-out unit 60 includes a storage unit 61 and multiple conveying rollers 62. The conveying-out unit 60 rolls the paper-roll sheet Md with the image formed thereon around a storage roll of the storage unit 61 using the conveying rollers 62, etc., and stores the paper-roll sheet Md.

When the paper-roll sheet Md is rolled around the storage roll of the storage unit 61, the pressure applied to the paper-roll sheet Md increases, which may highly likely increase the possibility that another image is transferred onto the back surface of the paper-roll sheet Md. In order to prevent the transfer of the image onto the back surface of the paper-roll sheet Md, a drying unit that further dries the paper-roll sheet Md just before the paper-roll sheet Md is rolled around the storage roll.

10. Configuration of Control Unit 70

The control unit 70 is a unit that has a configuration equivalent to a computer and executes a program that is stored in a storage unit with an operation processor to control operations of the image forming apparatus 100. In the embodiment, the control unit 70 instructs each component of the image forming apparatus 100 to operate and controls the operation of each component. The control unit 70 according to the embodiment will be described with reference to FIGS. 4 to 7.

The image forming apparatus 100 according to the embodiment of the invention may be used as a printing system for production printing. The production printing is a type of an image forming system that is a production system that makes it possible to print, for example, images on a large number of image forming media in a short time by efficiently managing jobs and print data. Specifically, the image forming apparatus 100 according to the embodiment includes multiple devices, such as a raster image processor (RIP) device and a printer. The RIP device is a device that controls the procedure for printing print data and converts the print data into raster image data. The printer is a control device that controls printing operations based on the converted raster image data.

The image forming apparatus 100 according to the embodiment is able to construct a workflow system that manages a workflow from creation of print data to distribution of printed matters. In other words, in the image forming apparatus 100 according to the embodiment, the devices, such as the RIP device and the printer, are separated in the system where the processing time is long as can be seen in this workflow to divide the processes, which enables faster printing.

Figure 4A:
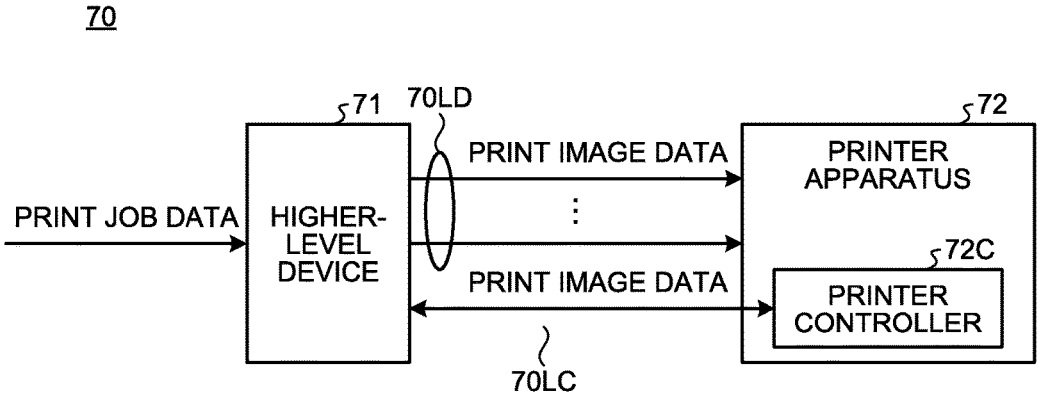
FIG. 4A is a schematic diagram of an exemplary image forming system according to the embodiment of the invention.
Figure 4B:
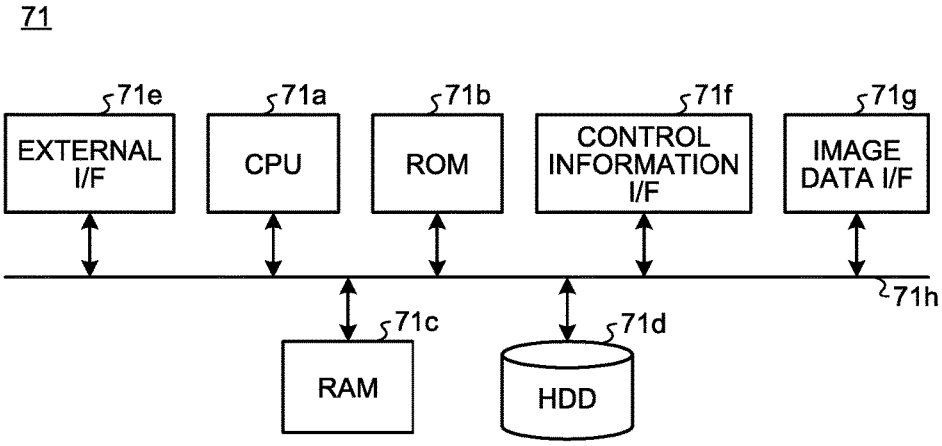
FIG. 4B is a schematic configuration diagram of an exemplary higher-level device according to the embodiment of the invention.

FIG. 4A is a schematic diagram of an exemplary image forming system according to the embodiment of the invention and FIG. 4B is a schematic configuration diagram of an exemplary higher-level device.

As illustrated in FIG. 4A, the image forming system according to the embodiment of the invention may divide the control unit 70 of the image forming apparatus 100 into an higher-level device (a RIP device, a DFE and a Digital FrontEnd) 71 that performs RIP processing, etc., and a printer apparatus 72 that performs print processing, etc. The higher-level device 71 and the printer apparatus 72 are connected to each other with multiple lines that are a data line 70LD and a control line 70LC. The data line 70LD is a data bus that is used to transmit print image data from the higher-level device 71 to the printer apparatus 72. The control line 70LC is a control bus for communicating print information data between the higher-level device 71 and a printer controller 72C of the printer apparatus 72.

Higher-Level Device 71

The higher-level device 71 corresponding to a part of the control unit 70 of the image forming apparatus 100 according to the embodiment of the invention is a device that performs the RIP processing on the basis of the print job data (job data and print data) that is output from a host device that issues an instruction on the content of the print processing to the image forming apparatus 100. In short, the higher-level device 71 according to the embodiment generates each set of print image data corresponding to each color on the basis of the print job data. The print image data according to the embodiment contains the "image data on the post processing" regarding ejection of the post-processing liquid that is ejected by the post-processing liquid application unit 50.

The higher-level device 71 according to the embodiment creates control information data for controlling printing operations on the basis of the print job data, the information of the host device, etc. The control information data contains, as printing conditions, data on a printing mode, a print type, paper feeding and ejection information, a printing surface order, a print paper size, a data size of print image data, a resolution, paper type information, gradation, color information and information, such as the number of pages to be printed. The control information data according to the embodiment contains post-processing liquid control data on ejection of the post-processing liquid that is ejected by the post-processing liquid application unit 50.

As illustrated in FIG. 4B, the higher-level device 71 according to the embodiment includes a central processing unit (CPU) 71*a*, a read only memory (ROM) 71*b*, a random access memory (RAM) 71*c*, and a hard disk drive (HDD) 71*d*. The higher-level device 71 further includes an external I/F 71*e*, a control information I/F 71*f*, and an image data I/F 71*g*. The higher-level device 71 further includes a bus 71*h* for connecting each of the units, such as the CPU 71*a*, and thus the units are communicable to one another.

The CPU 71*a* controls entire operations of the higher-level device 71. The CPU 71*a* implements a function of controlling operations of the higher-level device 71 using a control program and a post-processing agent application control program that are stored in the ROM 71*b* and/or the HDD 71*d*. Functional blocks that are implemented by the higher-level device 71 will be described below.

The ROM 71*b*, the RAM 71*c* and the HDD 71*d* are storage units that store data, etc. The ROM 71*b* and/or the HDD 71*d* store in advance the control program for controlling the CPU 71*a*. The RAM 71*c* is used as a work memory of the CPU 71*a*.

The external I/F 71*e* controls communications with the host device that is an external device of the image forming apparatus 100, etc. The control information I/F 71*f* controls communications of the control information data. The image data I/F 71*g* controls communications of the print image data.

Printer Apparatus 72

Figure 5:
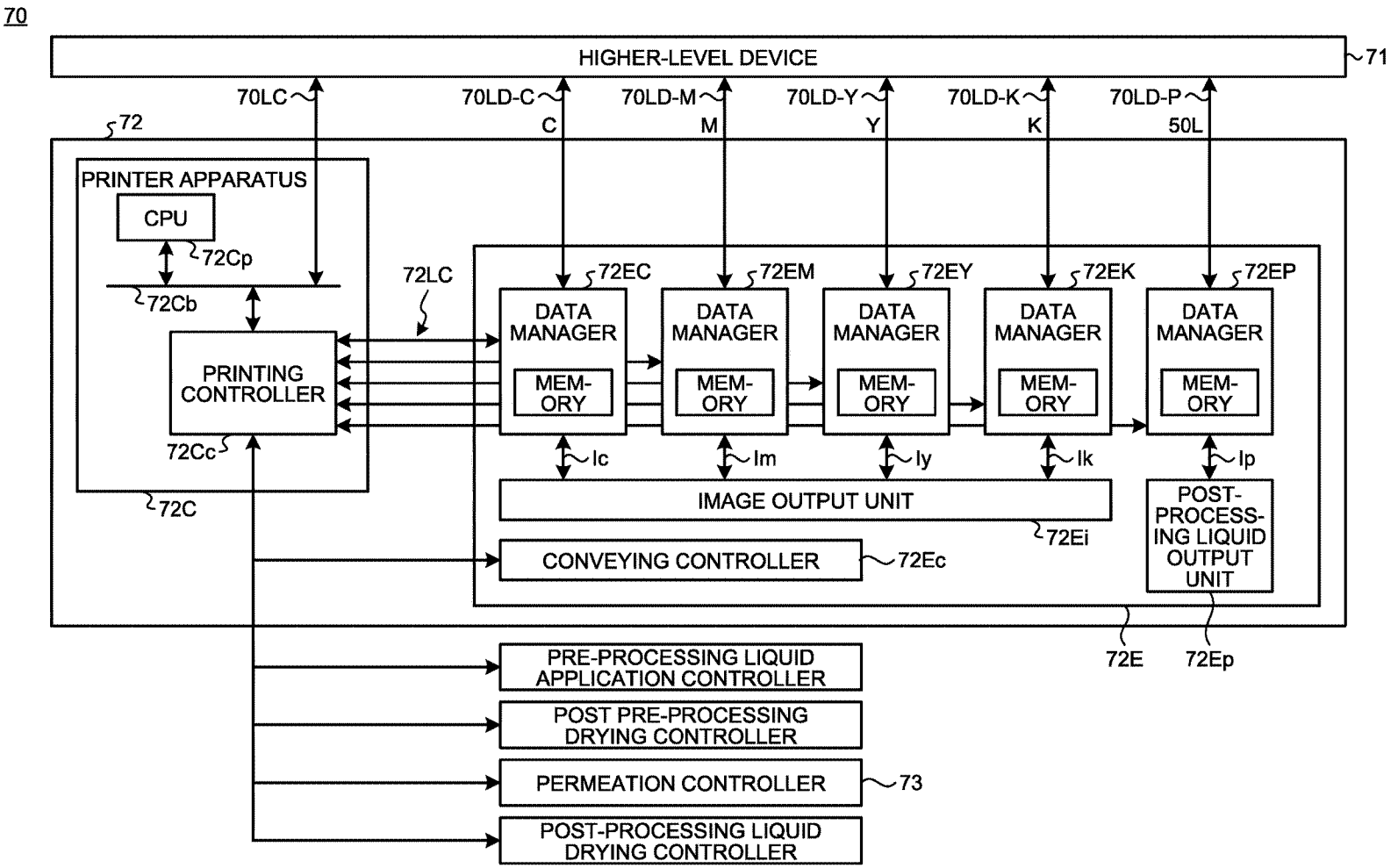
FIG. 5 is a functional block diagram of an image forming apparatus according to the embodiment of the invention.

FIG. 5 is a functional block diagram of the image forming apparatus 100 according to the embodiment of the invention, mainly illustrating the functional blocks of the printer apparatus 72 that constitutes the image forming apparatus 100. The functional blocks of the printer apparatus 72 may constitute the control unit 70 of the image forming apparatus 100 according to the embodiment. The printer apparatus 72 is an apparatus that controls operations of forming an image on a recording medium on the basis of the print image data and the control information data that are input from the higher-level device 71. The printer apparatus 72 includes the printer controller 72C and a printer engine 72E.

The printer controller 72C controls operations of the printer engine 72E. The printer controller 72C communicates the control information, etc., with the higher-level device 71 via the control line 70LC. The printer controller 72C communicates, for example, the control information data, etc., with the printer engine 72E via a control line 72LC. The printer controller 72C is able to control the printer engine 72E on the basis of the control information data and perform printing according to the control information data that contains a recording-medium type, a printing speed, an amount of droplets to be dropped, etc.

As illustrated in FIG. 5, the printer controller 72C includes a CPU 72Cp and a printing controller 72Cc. The printer controller 72C communicably connects the CPU 72Cp and the printing controller 72Cc via a bus 72Cb. The bus 72Cb is connected to the control line 70LC via the communication I/F.

The CPU 72Cp controls entire operations of the printer apparatus 72 using the control program that is stored in the ROM 71*b* (FIG. 4B). The printing controller 72Cc communicates commands and status information with the printer engine 72E on the basis of the control information data that is transmitted from the higher-level device 71 and the printing controller 72Cc controls operations of the printer engine 72E.

The printer engine 72E is a device that controls operations of forming an image on a recording medium on the basis of the print image data that is input from the higher-level device 71 and the control information data that is input from the printer controller 72C. The printer engine 72E is a device that controls post-processing operations on the basis of the print image data and t post-processing ejection pattern data that are input from the higher-level device 71 and the control information data and the post-processing control data that are input from the printer controller 72C.

As illustrated in FIG. 5, multiple data lines 70LD (70LD-Y, 70LD-C, 70LD-M, 70LD-K and 70LD-P) are connected to the printer engine 72E. The printer engine 72E receives the print image data from the higher-level device 71 via the multiple data lines 70LD. Thus, the printer engine 72E is able to perform printing operations corresponding to the respective colors and the post-processing operations on the basis of the received print image data.

The printer engine 72E includes multiple data managers 72EC, 72EM, 72EY, 72EK and 72EP. The printer engine 72E includes an image output unit (such as a head module) 72Ei to which the print image data, etc., is input from, for example, the data manager 72EC and a conveying controller 72Ec that controls conveying of the recording medium. The printer engine 72E further includes a post-processing liquid output unit 72Ep to which the image data on the post-processing is input from the data manager (post-processing controller) 72Ep.

The printer engine 72E further includes or is connected to a post-processing drying controller, a pre-processing liquid application controller, a post pre-processing drying controller, a permeation controller 73 and a pre-rolling drying controller.

Figure 6:
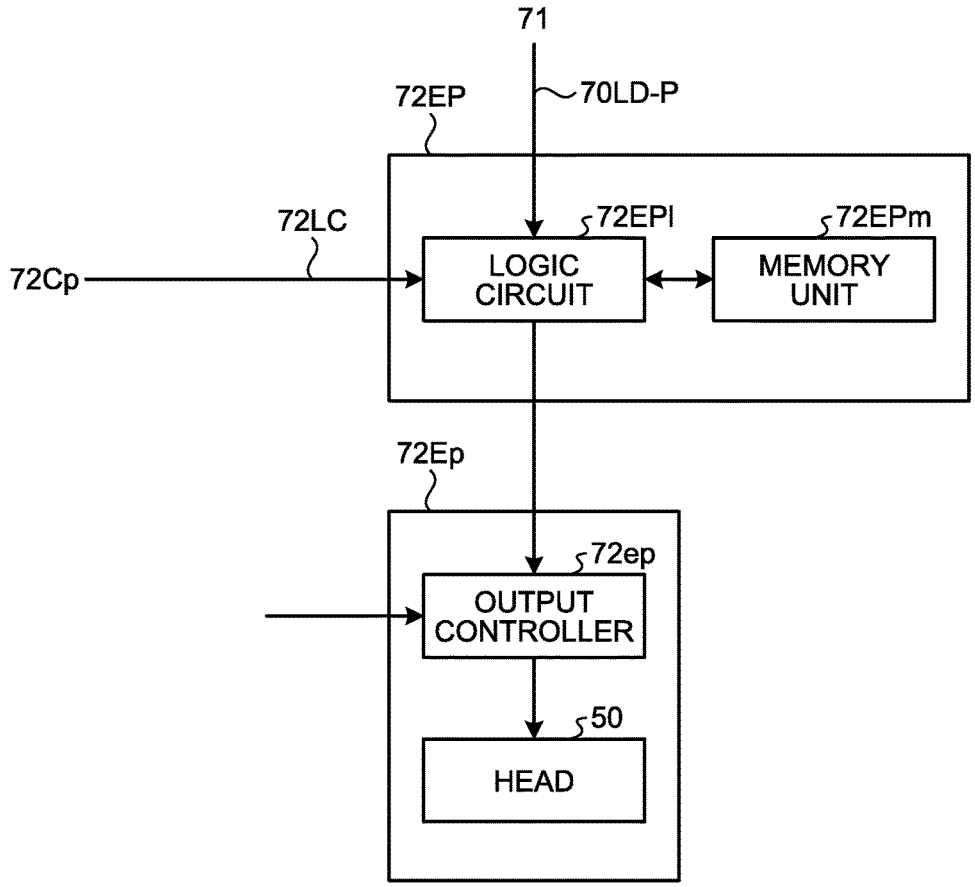
FIG. 6 is a functional block diagram illustrating an exemplary data manager of a control unit according to the embodiment of the invention.

The configuration of the data manager 72EP according to the post processing will be described with reference to FIG. 6. As illustrated in FIG. 6, the data manager 72EP includes a logic circuit 72EPl and a memory 72EPm. The logic circuit 72EPl is connected to the higher-level device 71 via the data line 70LD-P. The logic circuit 72EPl is connected to the printing controller 72Cc of the printer controller 72C via a control line 72LP.

The logic circuit 72EPl stores, in the memory 72EPm, the image data on the post-processing that is output from the higher-level device 71 on the basis of a control signal that is output from the printing controller 72Cc.

The memory 72EPm stores print image data that is output from the higher-level device 71 on the basis of the control signal that is output from the printing controller 72Cc.

A logic circuit 72ECl of the data manager 72EC reads print image data Ic corresponding to cyan (C) from a memory 72ECm and outputs the print image data Ic to the image output unit 72Ei.

The logic circuit 72EPl further receives, from the printing controller (control unit) 72Cc that is the control unit of the entire image forming system, information, such as a recording-medium type, an ink total amount regulatory value, a printing speed, a resolution of an image to be created, a droplet configuration (two values representing a large drop and no drop or four values representing a large drop, a middle drop, a small drop and no drop), an ink type (hereinafter, "operation parameter information").

A recommended value of the ink total amount regulatory value is determined according to the recording-medium type, the printing speed and the resolution of the image to be created. For this reason, when a setting is made such that a recommended value of the ink total amount regulatory value is determined, it is not necessary for the logic circuit 72EPl to receive the ink total amount regulatory value, and the logic circuit 72EPl may be configured to determine a recommended value of the ink total amount regulatory value from the recording-medium type, the printing speed, and the resolution of the image to be created.

The logic circuit 72EPl determines the amount (drop density) of droplets of the post-processing liquid per unit area (hereinafter, "an amount of the post-processing liquid to be applied") on the basis of the information that is received from the higher-level device 71 (or the printing controller Cc).

The logic circuit 72EPl outputs, to the post-processing liquid output unit 72Ep, a drive waveform corresponding to the post-processing liquid ejection pattern Ip that is a specific ejection pattern corresponding to the amount of the post-processing liquid to be applied that is determined as described above, or temporarily stores the post-processing liquid ejection pattern Ip to the memory EPm and outputs the post-processing liquid ejection pattern Ip to the post-processing liquid output unit 72Ep according to a control signal.

A hardware logic circuit configured of a combination of logic circuits may be used as the data manager 72EP.

Figure 7:
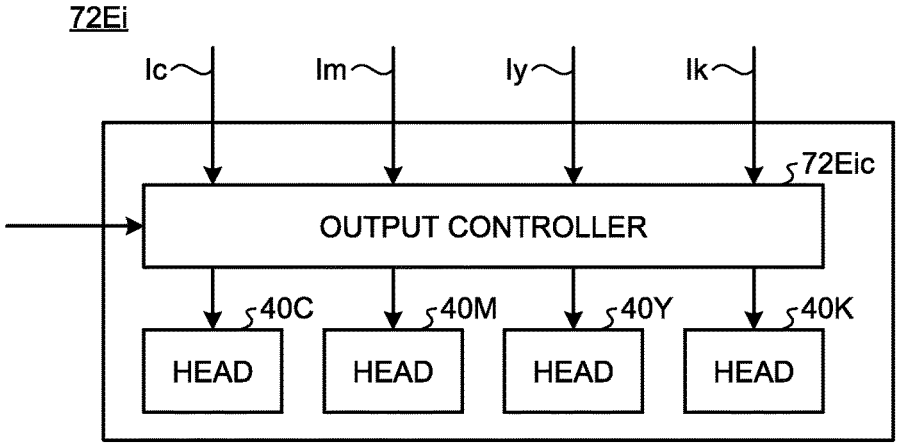
FIG. 7 is a functional block diagram illustrating an exemplary image output performed by the control unit according to the embodiment of the invention.

The configuration of the image output unit 72Ei will be described with reference to FIG. 7. As illustrated in FIG. 7, the image output unit 72Ei that is the head module that ejects ink droplets includes an output controller 72Eic and the ejection heads 40C, 40M, 40Y and 40K. The output controller 72Eic outputs print image patterns based on sets of print image data corresponding to the respective colors to the ejection heads 40C, 40M, 40Y and 40K corresponding to the respective colors. Accordingly, the output controller 72Eic is able to control operations of the ejection head 40C, etc., on the basis of the print image data.

Specifically, the drive waveforms corresponding to the image forming patterns (Ic, Im, Iy and Ik) that are created by the logic circuits of the respective data managers 72EC, 72EM, 72EY and 72EK are applied to the piezoelectric elements 45P that are the pressure generators of the ejection heads 40C, 40M, 40Y and 40K while the timing is controlled by the conveying controller 72Ec. Once the drive waveform is applied, the piezoelectric element 45P expands and contracts. The expansion and contraction forces work on the ink in the nozzle communication path 40R via the diaphragm 42 and a change occurs in the pressure in the nozzle communication path 40R and accordingly ink droplets are ejected from the nozzles 40N. In this manner, the output controller 72Eic is able to control operations of the ejection head 40*c*, etc., on the basis of the sets of print image data Ic to Ik.

The output controller 72Eic controls the multiple ejection heads 40C individually. The output controller 72Eic may control the ejection heads 40C, etc., simultaneously using the input print image data (such as Ic in FIG. 5). The output controller 72Eic may further control the ejection head 40C, etc., on the basis of a control signal that is output from the control unit 70. The output controller 72Eic may control the ejection head 40C, etc., for example, on the basis of a user operation input.

As in the case illustrated in FIG. 7, the post processing liquid output unit 72Ep that is the head module that ejects the post-processing liquid includes the output controller and the ejection head 50H. The output controller outputs the post-processing liquid ejection pattern Ip to the ejection head 50H (see FIG. 2). Specifically, the drive waveform corresponding to the post-processing liquid ejection pattern Ip, which is created by the logic circuit 72Ecl of the data manager 72EP, is applied to the piezoelectric element 45P of the ejection head 50H while the timing is controlled by the output controller. Because of the change in the pressure that occurs in the nozzle communication path 40R via the diaphragm 42, ink droplets are ejected from the nozzles 50N. The output controller is able to control operations of the ejection head 50H on the basis of the post processing ejection pattern Ip.

As described above, the printer apparatus 72 is able to control image forming corresponding to each color independently. In the printer apparatus 72, the configuration of the printer engine 72E may be changed according to the number of colors of the print image data (for example, C, M, Y and K or only K) or the number of ejection heads.

FIG. 5 will be referred back to here. The printer apparatus 72 controls the drying unit 30 and the permeation unit 55 using the permeation controller 73 and the post-processing liquid drying controller that are connected to the printing controller 72Cc and using the recording-medium type and the amounts of ink and the post processing liquid to be applied.

The printer apparatus 72 properly controls the pre-processing operations of the pre-processing controller, the pre-processing drying controller that are connected to the printing controller 72Cc according to the recording-medium type and the imaged data.

11. Control on Post-Processing Liquid Ejection Pattern

Figure 8:
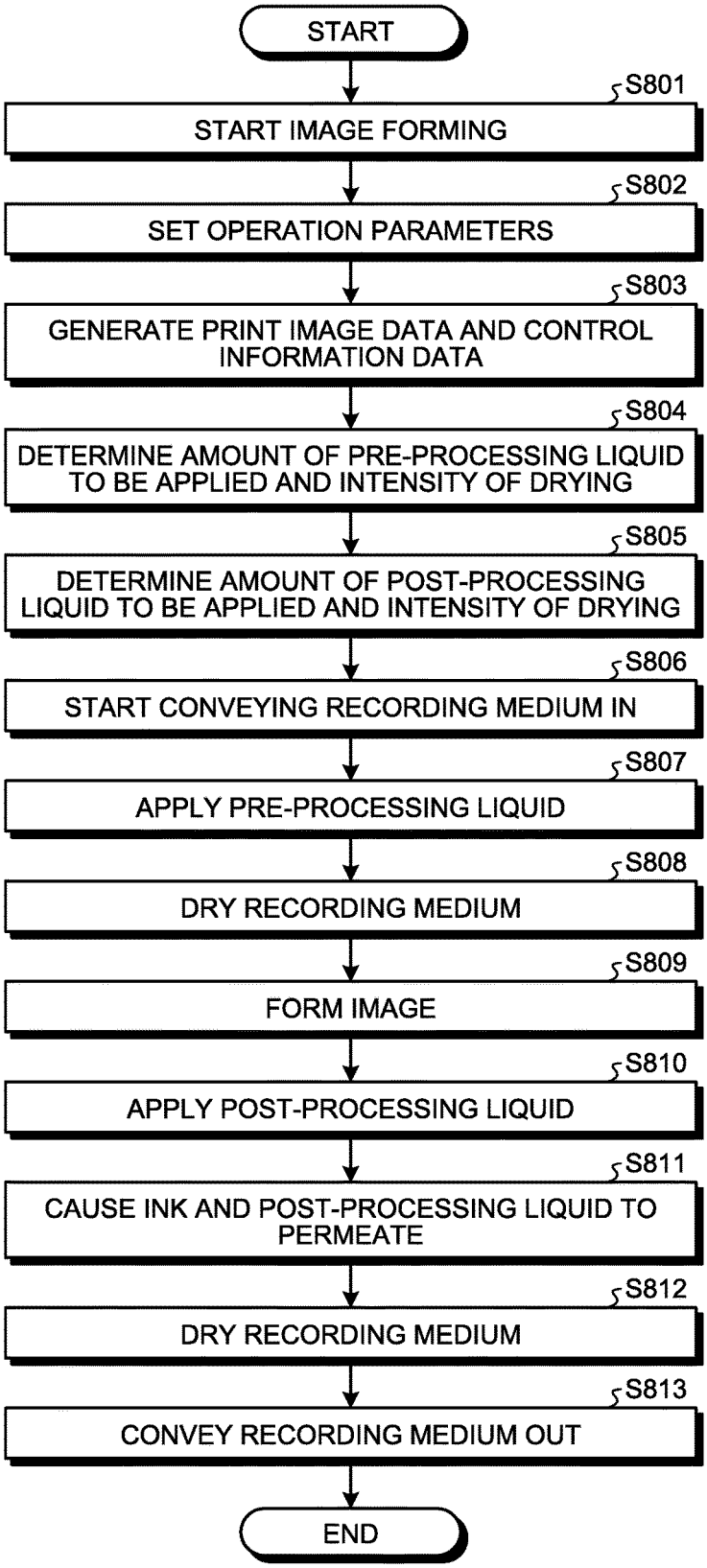
FIG. 8 is a flowchart of exemplary operations of the image forming apparatus according to the embodiment of the invention.

Operations performed by the image forming apparatus 100 according to the embodiment to form an image will be described with reference to FIG. 8. FIG. 8 is a flowchart for explaining operations performed the image forming apparatus 100 to form an image. Each unit of the image forming apparatus 100 performs image forming operations according to the following steps.

The control unit 70 of the image forming apparatus 100 starts image forming and printing on the basis of print job data, operation parameter information, etc., that are input externally (S801). As described above, the control unit 70 of the image forming apparatus 100 may have a configuration in which the functions are divided to, for example, those of the higher-level device 71 and the printer apparatus 72. In the following descriptions, the control unit 70 of the image forming apparatus 100 is implemented in the printing controller 72Cc of the printer apparatus 72. Thus, following process S801, the control unit 70 of the image forming apparatus 100 stores (sets) the print job data, the operation parameter information, etc., which are input, in the storage units that are higher-level devices with respect to the control unit 70 (such as the ROM 71*b*, the RAM 71*c* and the HDD 71*d*).

By using the control unit 70, the image forming apparatus 100 generates print image data, control information data etc., on the basis of the content stored in the ROM 71*b*, the RAM 71*c* and the HDD 71*d* (S803).

By using the control unit 70 and on the basis of the generated control information data, the image forming apparatus 100 determines an amount of the pre-processing liquid to be applied and the intensity of drying of the pre-processing liquid at S808 (S804).

By using the control unit 70 and on the basis of the operation parameter information that is set, the image forming apparatus 100 determines the amount of the post-processing liquid to be applied and the intensity of drying of the post-processing liquid at S812 (S805). In other words, in the embodiment, the control unit 70 functions as the post-processing agent application control device. The image forming apparatus 100 may be configured to perform the process at S805 using the higher-level device 71. In other words, the higher-level device 71 may be configured to function independently as the post-processing agent application control device. The image forming apparatus 100 may be configured to perform the process at S805 using the printer apparatus 72. In other words, the printer apparatus 72 may be configured to function independently as the post-processing agent application control device. The method of determining an amount of the post-processing liquid to be applied at S805 is one of arguments according to the embodiment. The method of determining an amount of the post-processing liquid to be applied at S805 will be described below with reference to FIG. 10.

By using the conveying-in unit 10, the image forming apparatus 100 starts conveying a recording medium into the pre-processing liquid application unit 20, etc. (S806). The image forming apparatus 100 may perform S806 immediately after starting image formation at S801.

By using the pre-processing liquid application unit 20, the image forming apparatus 100 performs the pre-processing and applies the pre-processing liquid (S807). The pre-processing liquid drying unit 31 applies the pre-processing liquid according to the amount of the pre-processing liquid to be applied that is determined at S804.

By using the pre-processing liquid drying unit 31, the image forming apparatus 100 dries the recording medium (S808). The pre-processing liquid drying unit 31 dries the recording medium according to the intensity of drying of the pre-processing liquid that is determined at S804.

By using the image forming unit 40, the image forming apparatus 100 forms an image on the front surface of the recording medium on the basis of the print image data that is generated at S803 (S809).

The image forming unit 40 is able to form an image by further using the type of the recording medium and the resolution of the image to be formed. The image forming unit 40 is able to control the operations to form an image by controlling the drive voltage to be applied to the piezoelectric element.

By using the post-processing liquid application unit 50, the image forming apparatus 100 performs the post-processing on the recording medium (S810). The post-processing liquid application unit 50 applies the post-processing liquid according to the amount of the post-processing liquid to be applied, which is determined at S805.

By using the permeation unit 55, the image forming apparatus 100 causes the ink and the post-processing liquid to permeate the recording medium (S811).

By using the post-processing liquid drying unit 32, the image forming apparatus 100 dries the recording medium (S812). The post-processing liquid drying unit 32 dries the recording medium according to the intensity of drying that is determined at S805.

By using the conveying-out unit 60, the image forming apparatus 100 conveys the recording medium out of the image forming apparatus 100 (S813). Thereafter, the image forming apparatus 100 ends the operations to form an image.

Figure 9A:
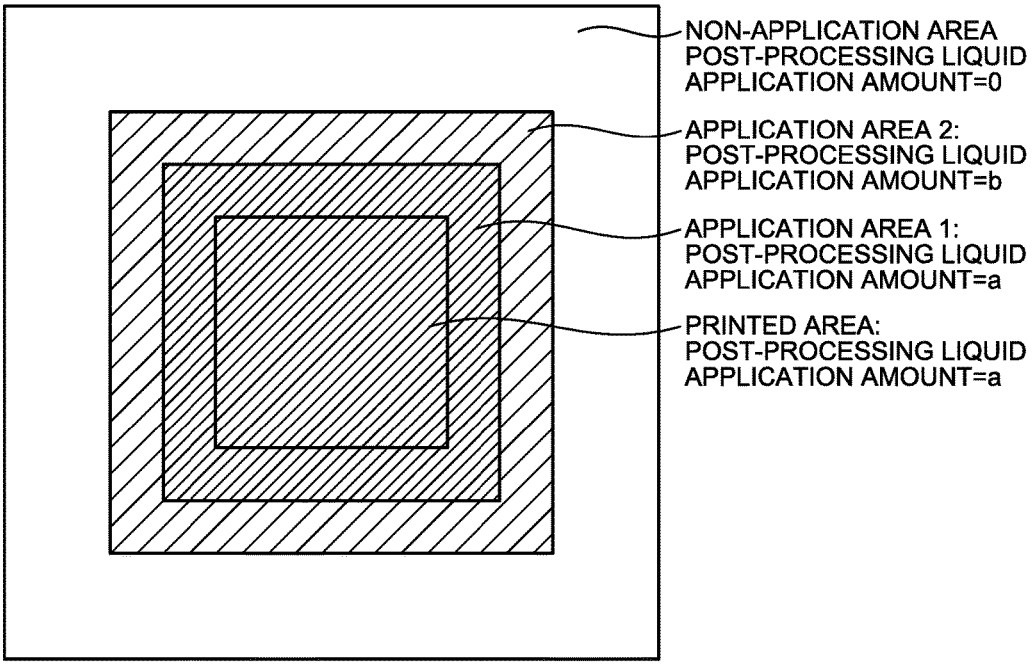
FIGS. 9A and 9B are views for explaining a method of applying a post-processing liquid performed by a post-processing liquid application unit according to the embodiment of the invention.
Figure 9B:
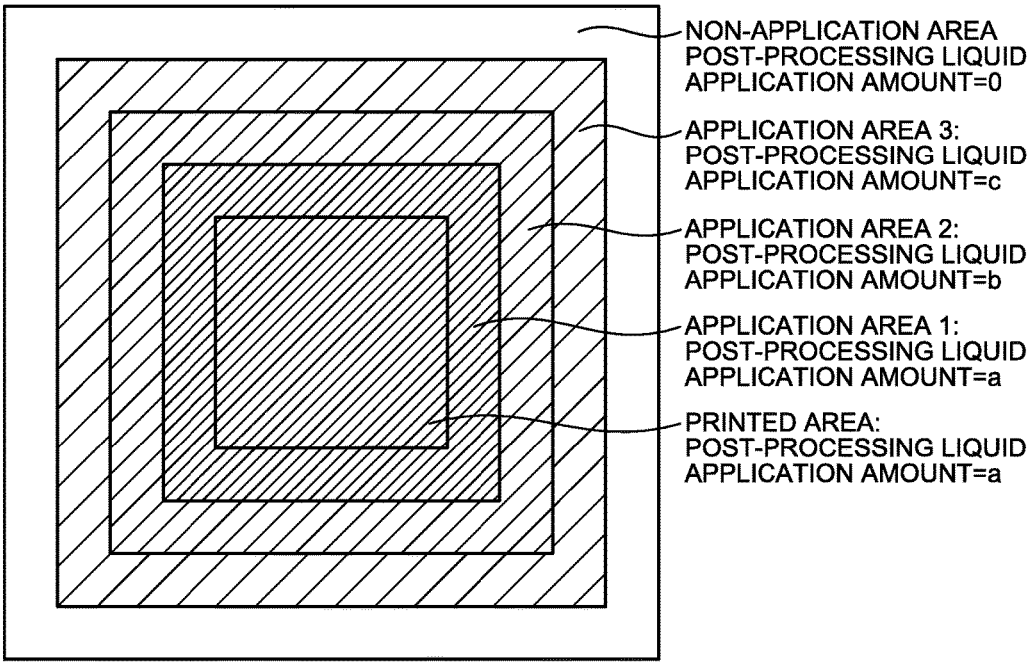

12. Method of Applying Post-Processing Liquid Performed by Post-Processing Liquid Application Unit The method of applying the post-processing liquid performed by the post-processing liquid application unit 50 according to the embodiment will be described with reference to FIGS. 9A and 9B. FIGS. 9A and 9B are views for explaining the method of applying the post-processing liquid performed by the post-processing liquid application unit 50 according to the embodiment.

In the embodiment, the post-processing liquid application unit 50 is configured to apply the post-processing agent to the printed surface of a printed matter after printing in order to improve the fixability (rub resistance) of the printed area. In the embodiment, the post-processing liquid application unit 50 is configured to apply the post-processing liquid to only the printed area because it is necessary to reduce the amount of the post-processing liquid to be applied in order to reduce the cost per page (CPP) and increase the dryness.

When the post-processing liquid is applied to only the printed area, the post processing liquid may be applied to a shifted position from the printed area depending on the printing accuracy, the accuracy in applying the post-processing liquid, and the accuracy in conveying the recording medium. For this reason, the post-processing liquid application unit 50 applies the post-processing liquid to an area wider than the printed area (image area) in consideration of the accuracy.

When the post-processing liquid is applied to the area wider than the printed area, the post processing liquid is applied also to a part of the unprinted area that is an area other than the printed area (non-image area). The area that is a part of the unprinted area and to which the post-processing liquid is applied is referred to as the "application area". The glossiness of the application area and the glossiness of the non-application area that is the unprinted area to which the post-processing liquid is not applied are different from each other. In short, a difference occurs in glossiness at the boundary between the application area and the non-application area.

The image forming apparatus 100 according to the embodiment is thus configured to determine an amount of the post-processing liquid to be applied in the following manner when the difference in glossiness at the boundary between the application area and the non-application area exceeds a maximum glossiness difference (predetermined value: X). The glossiness according to the embodiment is an index representing the degree of regular reflection of light on the surface of an object. The glossiness according to the embodiment may be measured directly or indirectly using a gloss meter or may be calculated from the result of measurement using a gloss meter. For example, the glossiness may be calculated from discrete values acquired with a gloss meter using a function. It is preferable that a gloss meter that meets the ISO standards or JIS standards be used; however, the gloss meter is not limited to this. The glossiness difference according to the embodiment represents the difference in glossiness.

In other words, in such a case, the image forming apparatus 100 according to the embodiment is configured as illustrated in FIGS. 9A and 9B to change the amount of the post-processing liquid to be applied, in a stepwise manner from the application area to the non-application area such that the difference in glossiness at the boundary between adjacent application areas and the difference in glossiness at the boundary between an application area and a non-application area adjacent to each other are equal to or smaller than the maximum glossiness difference. The stepwise change of the amount of the post-processing liquid to be applied is a decrease or an increase of the amount of the post-processing liquid to be applied from the adjacent application area. The specific method of determining an amount of the post-processing liquid to be applied will be described with reference to FIG. 10.

The image forming apparatus 100 according to the embodiment is configured as described above and accordingly is able to, while reducing the amount of the post-processing liquid to be applied, reduce the glossiness difference at the boundary between the area to which the post-processing liquid is applied and the area to which the post-processing liquid is not applied.

The application area to which the same amount of the post-processing liquid as of the printed area will be referred to as an application area 1. The application area 1 is an area that is a wider area than the printed area to which the post-processing liquid has been applied in consideration of the accuracy in applying the post-processing liquid. As described with reference to FIGS. 9A and 9B, the area where the amount of the post-processing liquid to be applied is changed in a stepwise manner from the application area 1 to the non-application area will be referred to as an "application area 2" and an "application area 3" and the application areas will be denoted with the numbers.

13. Method of Determining Amount of Post-Processing Liquid to be Applied

Figure 10:
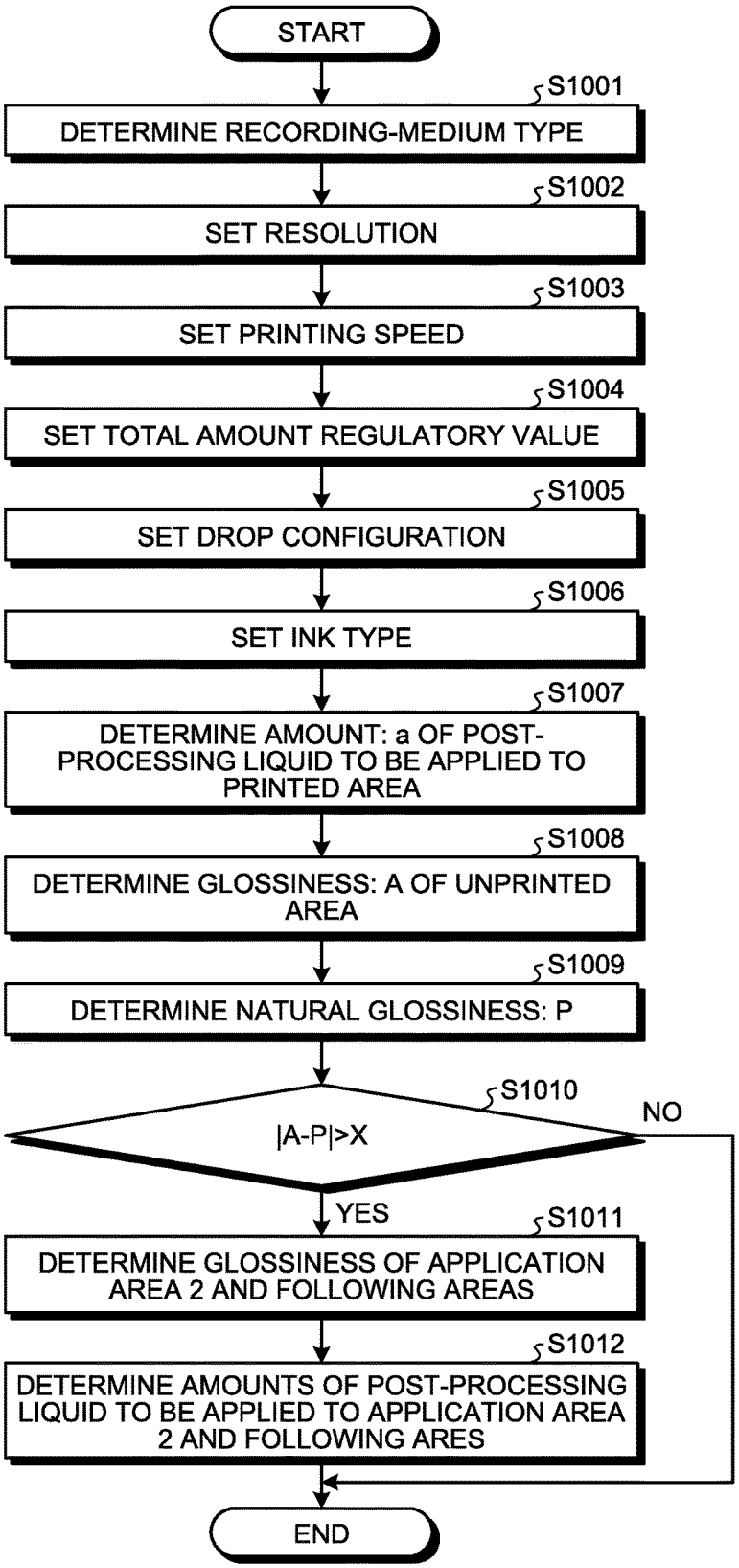
FIG. 10 is a diagram for explaining a process performed by the image forming apparatus to determine the amount of the post-processing liquid to be applied according to the embodiment of the invention.

The method performed by the image forming apparatus 100 according to the embodiment to determine an amount of the post-processing liquid to be applied (a post-processing agent application control method) will be described with reference to FIG. 10. FIG. 10 is a diagram for explaining a process performed by the image forming apparatus 100 according to the embodiment to determine an amount of the post-processing liquid to be applied.

When the image forming apparatus 100 according to the embodiment determines an amount of the post-application liquid to be applied, first of all, the control unit 70 sets a recording-medium type, a resolution of an image to be created, a printing speed, an ink total amount regulatory value, a droplet configuration, and an ink type (S1001 to S1006). The content of the settings may be set by the user or may be set in advance.

With reference to a post-processing liquid application determination table and from the recording-medium type, the resolution of the image to be created, the printing speed, the ink total amount regulatory value, the droplet configuration and the ink type, the control unit 70 determines "a" that is an amount of the post-processing liquid to be applied that is necessary to secure the rub resistance of the printed area (S1007). In short, in the embodiment, the control unit 70 functions as a first post-processing agent application amount determination unit.

The post-processing liquid application amount determination table will be described here with reference to FIG. 11. FIG. 11 is a diagram of an exemplary post-processing liquid application amount determination table according to the embodiment.

As illustrated in FIG. 11, the post-processing liquid application amount determination table according to the embodiment is a table for determining an amount of the post-processing liquid to be applied that is necessary to secure the fixability (rub resistance) of the printed area from the recording-medium type, the resolution of the image to be created, the ink total amount regulatory value, the droplet configuration and the ink type. The post-processing liquid application amount determination table is stored in advance in a storage unit (such as the ROM 71*b*, the RAM 71*c* or the HDD 71*d*).

The control unit 70 refers to an unprinted-area glossiness determination table corresponding to the recording-medium type that is set at S1001 and, from "a" that is the amount of the post-processing liquid to be applied and that is determined at S1007, determines "A" that is a glossiness in the case where that amount of the post-processing liquid is applied to the unprinted area of the recording medium of the type that is set at S1001 (S1008). In other words, in the embodiment, the control unit 70 functions as a first glossiness determination unit and determines a glossiness "A" as a first glossiness.

The unprinted-area glossiness determination table will be described with reference to FIG. 12. FIG. 12 is a diagram of an exemplary unprinted-area glossiness determination table according to the embodiment.

Figure 13:
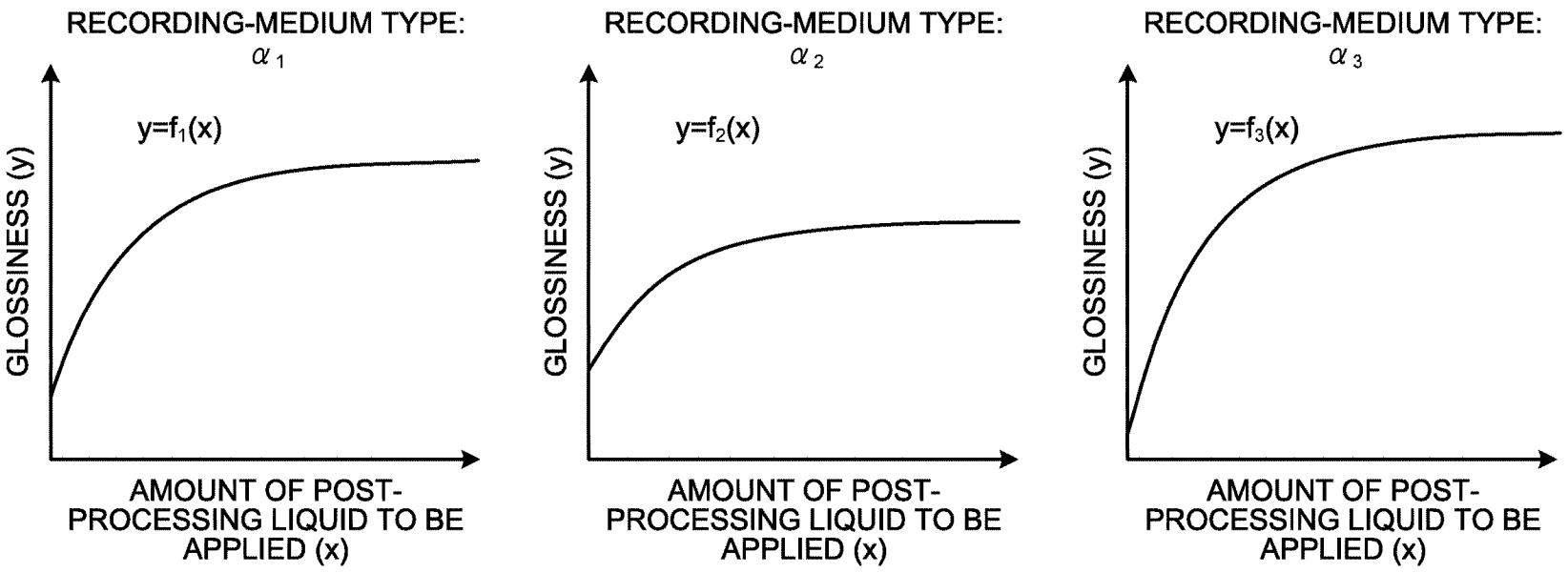
FIG. 13 is a diagram of another exemplary unprinted-area glossiness determination table according to the embodiment of the invention.

As illustrated in FIG. 12, there are unprinted-area glossiness determination tables with respect to the respective recording-medium types. The unprinted-area glossiness determination table is a table for determining, from the amount of the post-processing liquid to be applied, a glossiness in the case where that amount of the post-processing liquid is applied to the unprinted area of the recording medium of the corresponding type. The unprinted-area glossiness determination tables are stored in advance in a storage unit (such as the ROM 71*b*, the RAM 71*c* or the HDD 71*d*). The unprinted-area glossiness determination table may be stored not as a table but as a function having the amount of the post-processing liquid to be applied as a variable as illustrated in FIG. 13.

The control unit 70 refers to a natural glossiness determination table and determines "P" that is a natural glossiness of a recording medium of the type that is set at S1001 (S1009). The natural glossiness is the glossiness of the recording medium. In other words, in the embodiment, the control unit 70 functions as a second glossiness determination unit and determines "P" that is the natural glossiness as a second glossiness.

The natural glossiness determination table will be described with reference to FIG. 14. FIG. 14 is a diagram of an exemplary natural glossiness determination table according to the embodiment.

As illustrated in FIG. 14, the natural glossiness determination table according to the embodiment is a table for determining, from a recording-medium type, a natural glossiness of a recording medium of the type. The natural glossiness determination table is stored in advance in a storage medium (such as the ROM 71*b*, the RAM 71*c* or the HDD 71*d*).

The control unit 70 determines whether the difference between "A" that is the glossiness of the unprinted area, which is determined at S1008, and "P" that is the natural glossiness, which is determined at S1009, exceeds "X" that is a maximum glossiness difference that is allowable quality, i.e., whether $|A-P|>X$ is satisfied (S1010). In other words, in the embodiment, the control unit 70 functions as a comparison unit.

On determining that the $|A-P|>X$ is not satisfied in the determination process at S1010 (NO at S1010), the control unit 70 ends the post-processing application amount determination process.

On the other hand, on determining that the $|A-P|>X$ is satisfied in the determination process at S1010 (YES at S1010), the control unit 70 refers to the application area glossiness determination table and, from "A" that is the glossiness of the unprinted area determined at S1008 and "P" that is the natural glossiness determined at S1009, determines the glossiness of the application area 2 and the following areas such that the glossiness difference at the boundary between the adjacent application areas and the glossiness difference at the boundary between the application area and the non-application area that are adjacent to each other are equal or smaller than "X" that is the maximum glossiness difference (S1011). In other words, in the embodiment, the control unit 70 functions as a third glossiness determination unit and determines the glossiness of the application area 2 and the following areas as a third glossiness.

The application area glossiness determination table will be described with reference to FIG. 15. FIG. 15 is a diagram of an exemplary application area glossiness determination table according to the embodiment. FIG. 15 illustrates, as an example, the case where "X" that is the maximum glossiness difference is 10.

As illustrated in FIG. 15, the application area glossiness determination table is a table for determining the glossiness of the application area 2 and the following areas from "A" that is the glossiness of the unprinted area and "P" that is the natural glossiness such that the glossiness difference at the boundary between the adjacent application areas and the glossiness difference at the boundary between the application area and the non-application area that are adjacent to each other are equal to or smaller than "X" that is the maximum glossiness difference.

Furthermore, as illustrated in FIG. 15, the control unit 70 according to the embodiment is configured to, as the difference between the natural glossiness of the recording medium and the glossiness of the unprinted area increases, reduce the amount of the post-processing liquid to be applied from the application area to the non-application area or increase the steps according to which the amount is increased.

The control unit 70 according to the embodiment is configured as described above and thus is able to, even when the difference between the natural glossiness of the recording medium and the glossiness of the unprinted area is larger than the twofold of "X" that is the maximum glossiness difference ($|A-P|>2X$), keep the glossiness difference at the boundary between the adjacent application areas and the glossiness difference at the boundary between the application area and the non-application area that are adjacent to each other equal to or smaller than "X" that is the maximum glossiness difference.

In order to reduce the cost per page, the smaller the amounts of the post-processing liquid to be applied to the application area 2 and the following areas are, the better it is. Thus, it is preferable that the amount of the post-processing liquid to be applied to the application area 2 and the following areas be set smaller as much as possible in the application area glossiness determination table.

The control unit 70 refers to the non-application area glossiness determination table (FIG. 12) corresponding to the recording-medium type that is set at S1001 and, from the glossiness determined at S1001, determines amounts of the post application liquid to be applied to the application area 2 and the following areas (S1012). In other words, in the embodiment, the control unit 70 functions as a second post-processing agent application amount determination unit.

The image forming apparatus 100 according to the embodiment performs the post-processing liquid determination process described above to determine an amount of the post-processing liquid to be applied.

In the image forming apparatus 100 according to the embodiment, the user can set each of "X" that is the maximum glossiness difference and the distance between the application area N (N is a natural number) and the application area N+1.

As described above, the post-processing liquid application unit 50 according to the embodiment is configured to, when the glossiness difference at the boundary between the application area and the non-application area exceeds the maximum glossiness difference, reduce or increase the amount of the post-processing liquid to be applied, in a stepwise manner from the application area to the non-application area such that the glossiness difference at the boundary between the adjacent application areas and the glossiness difference at the boundary between the application area and the non-application area are equal to or smaller than the maximum glossiness difference.

The image forming apparatus 100 according to the embodiment is configured as described above and thus is able to, while reducing the amount of the post-processing liquid to be applied, reduce the glossiness difference at the boundary between the area to which the post-processing liquid is applied and the area to which the post-processing liquid is not applied.

The inkjet image forming apparatus that applies the post-processing liquid to a recording medium has been described as the embodiment. The invention is also applicable to an electrophotographic image forming apparatus that applies toner for post-processing that is a type of a post-processing agent to a recording medium.

14. Functional Configuration of Control Unit 70

The functional configuration of the control unit 70 of the image forming apparatus 100 according to the embodiment will be described with reference to the accompanying drawings. As described above, the control unit 70 according to the embodiment can be divided into the higher-level device 71 and the printer apparatus 72 (see FIGS. 4 to 7). Each of the higher-level device 71 and the printer apparatus 72 includes an arithmetic logic unit. The arithmetic logic unit and the post-processing agent application control program according to the invention implement the functional blocks of the control unit 70 to be described below.

Higher-Level Device 71

Figure 16:
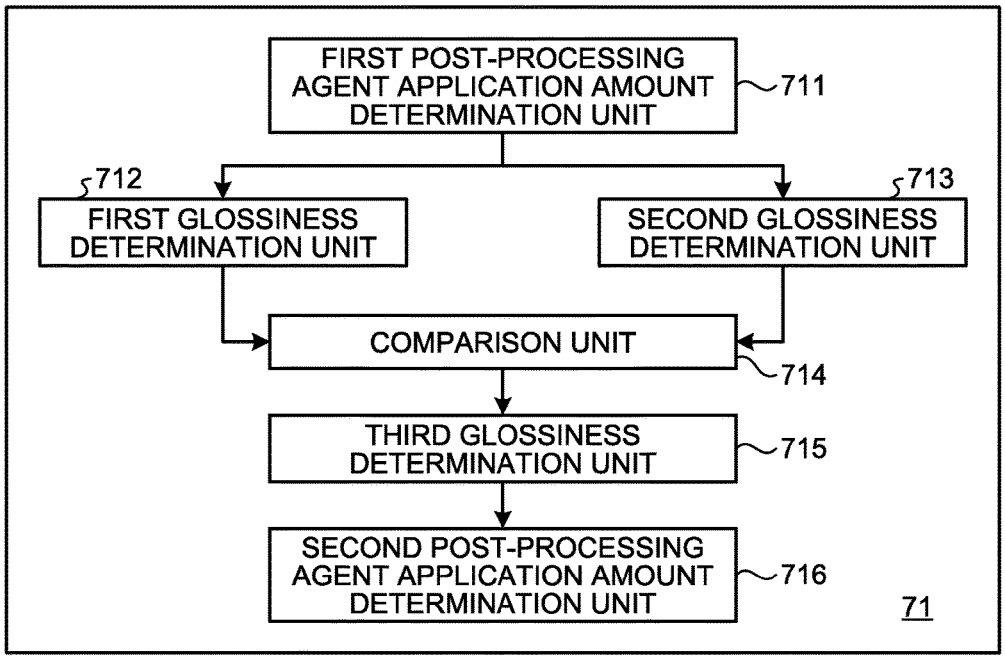
FIG. 16 is a functional block diagram of a functional configuration of a control unit of an higher-level device according to the embodiment of the invention.

FIG. 16 is a functional block diagram of a functional configuration of the control unit 70 according to the embodiment that is implemented by the CPU 71*a* of the higher-level device 71 that is the processor. As illustrated in FIG. 16, the higher-level device 71 includes a first post-processing agent application amount determination unit 711, a first glossiness determination unit 712, a second glossiness determination unit 713, a comparison unit 714, a third glossiness determination unit 715 and a second post-processing agent application amount determination unit 716.

From a recording-medium type, a resolution of an image to be created, a printing speed, an ink total amount regulatory value, a droplet configuration and an ink type that are set by a user or are set in advance, the first post-processing agent application amount determination unit 711 determines "a" that is an amount of the post-processing liquid to be applied that is necessary to secure the rub resistance of the printed area.

The first glossiness determination unit 712 refers to the unprinted-area glossiness determination table corresponding to the recording-medium type that is set by the user or that is set in advance and, from "a" that is the amount of the post-processing liquid to be applied and that is determined by the first post-processing agent application amount determination unit 711, determines "A" that is a glossiness in the case where that amount of the post-processing liquid is applied to the unprinted area of the recording medium of the type that is set. The determined "A that is a glossiness" is a first glossiness.

The second glossiness determination unit 713 refers to the natural glossiness determination table and determines "P" that is a natural glossiness of a recording medium of the type that is set by the user or set in advance. Note that the natural glossiness is the glossiness of the recording medium.

The comparison unit 714 compares "A" that is the glossiness of the unprinted area and is determined by the first glossiness determination unit 712 and "P" that is the natural glossiness and is determined by the second glossiness determination unit 713. On the basis of the comparison, it is determined whether the difference between "A" and "P" exceeds "X" that is a maximum glossiness difference that is allowable quality, i.e., whether $|A-P|>X$ is satisfied.

On determining that the $|A-P|>X$ is satisfied on the basis of the result of the comparison performed by the comparison unit 714, the third glossiness determination unit 715 refers to the application area glossiness determination table and, from "A" that is the glossiness of the unprinted area and "P" that is the natural glossiness, determines the glossiness of the application area 2 and the following areas such that the glossiness difference at the boundary between adjacent application areas and the glossiness difference at the boundary between the application area and the non-application area that are adjacent to each other are equal or smaller than "X" that is the maximum glossiness difference.

The second post-processing agent application amount determination unit 716 refers to the non-application area glossiness determination table (FIG. 12) corresponding to the recording-medium type that is set by the user or set in advance and, from the glossiness determined by the third glossiness determination unit 715, determines amounts of the post application liquid to be applied to the application area 2 and the following areas.

The control unit 70 according to the embodiment having the above-described configuration is able to, while reducing the amount of the post-processing liquid to be applied, reduce the glossiness difference at the boundary between the area to which the post-processing liquid is applied and the area to which the post-processing liquid is not applied.

Printer Apparatus 72

Figure 17:
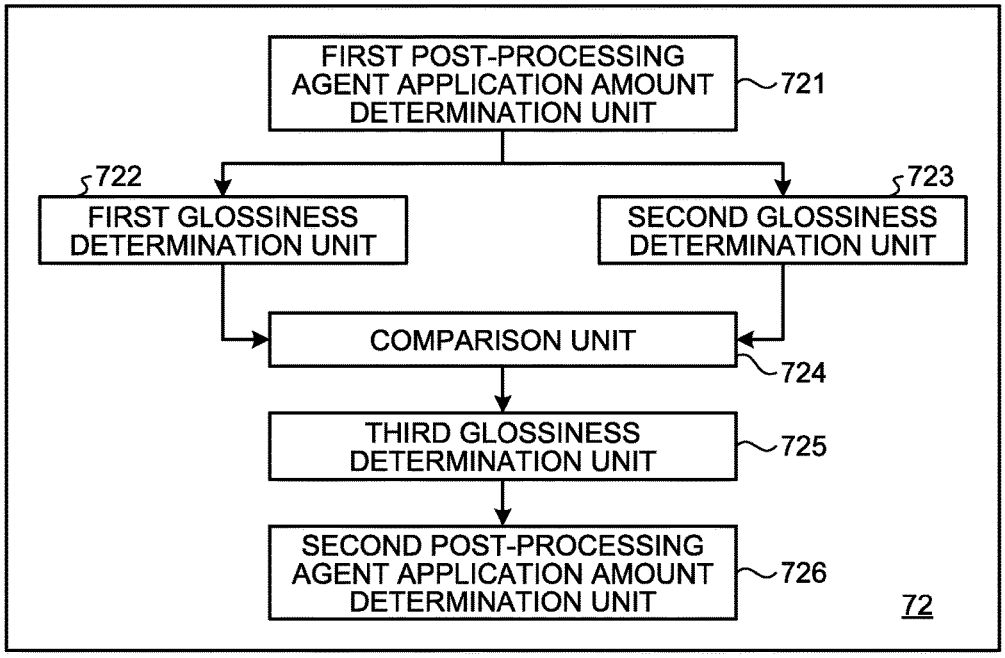
FIG. 17 is a functional block diagram of a functional configuration of a control unit of a printer device according to the embodiment of the invention.

FIG. 17 is a functional block diagram of an exemplary functional configuration of the control unit 70 according to the embodiment that is implemented by the CPU 72Cp of the printer apparatus 72 that is the processor. As illustrated in FIG. 17, the printer apparatus 72 includes a first post-processing agent application amount determination unit 721, a first glossiness determination unit 722, a second glossiness determination unit 723, a comparison unit 724, a third glossiness determination unit 725 and a second post-processing agent application amount determination unit 726.

From a recording-medium type, a resolution of an image to be created, a printing speed, an ink total amount regulatory value, a droplet configuration and an ink type that are set by a user or are set in advance, the first post-processing agent application amount determination unit 721 determines "a" that is an amount of the post-processing liquid to be applied that is necessary to secure the rub resistance of the printed area.

The first glossiness determination unit 722 refers to the unprinted-area glossiness determination table corresponding to the recording-medium type that is set by the user or that is set in advance and, from "a" that is the amount of the post-processing liquid to be applied and that is determined by the first post-processing agent application amount determination unit 721, determines "A" that is a glossiness in the case where that amount of the post-processing liquid is applied to the unprinted area of the recording medium of the type that is set. The determined "A that is a glossiness" is a first glossiness.

The second glossiness determination unit 723 refers to the natural glossiness determination table and determines "P" that is a natural glossiness of a recording medium of the type that is set by the user or set in advance. Note that the natural glossiness is the glossiness of the recording medium.

The comparison unit 724 compares "A" that is the glossiness of the unprinted area and is determined by the first glossiness determination unit 722 and "P" that is the natural glossiness and is determined by the second glossiness determination unit 723. On the basis of the comparison, it is determined whether the difference between "A" and "P" exceeds "X" that is a maximum glossiness difference that is allowable quality, i.e., whether $|A-P|>X$ is satisfied.

On determining that the $|A-P|>X$ is satisfied on the basis of the result of the comparison performed by the comparison unit 724, the third glossiness determination unit 725 refers to the application area glossiness determination table and, from "A" that is the glossiness of the unprinted area and "P" that is the natural glossiness, determines the glossiness of the application area 2 and the following areas such that the glossiness difference at the boundary between adjacent application areas and the glossiness difference at the boundary between the application area and the non-application area that are adjacent to each other are equal or smaller than "X" that is the maximum glossiness difference.

The second post-processing agent application amount determination unit 726 refers to the non-application area glossiness determination table (FIG. 12) corresponding to the recording-medium type that is set by the user or set in advance and, from the glossiness determined by the third glossiness determination unit 725, determines amounts of the post application liquid to be applied to the application area 2 and the following areas.

The control unit 70 according to the embodiment having the above-described configuration is able to, while reducing the amount of the post-processing liquid to be applied, reduce the glossiness difference at the boundary between the area to which the post-processing liquid is applied and the area to which the post-processing liquid is not applied.

According to an embodiment, it is possible to reduce the difference in glossiness at the boundary between the area to which the post-processing agent is applied and the area to which the post-processing agent is not applied.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A post-processing agent application control device configured to control application of a post-processing agent to a recording medium by a post-processing agent application device, the post-processing agent application control device comprising:

a first post-processing agent application amount determination unit configured to determine an amount of the post-processing agent to be applied to an image formed on the recording medium;

a first glossiness determination unit configured to determine a first glossiness that is a glossiness of a non-image area of the recording medium in a case where the determined amount of the post-processing agent is applied to the non-image area;

a comparison unit configured to compare a glossiness difference between the determined first glossiness and a second glossiness that is a glossiness of the non-image area of the recording medium, with a predetermined value; and a second post-processing agent application amount determination unit configured to, if the glossiness difference is larger than the predetermined value, change an amount of the post-processing agent to be applied, in a stepwise manner from an image area to the non-image area.

2. The post-processing agent application control device according to claim 1, wherein the second post-processing agent application amount determination unit is configured to, if the glossiness difference is larger than the predetermined value, determine an amount of the post-processing agent to be applied to the non-image area such that a glossiness difference from the first glossiness and a glossiness difference from the second glossiness are equal to or smaller than the predetermined value.

3. The post-processing agent application control device according to claim 1, further comprising a third glossiness determination unit configured to, if the glossiness difference is larger than the predetermined value, determine a third glossiness such that the glossiness difference from the first glossiness and the glossiness difference from the second glossiness are equal to or smaller than the predetermined value, wherein the second post-processing agent application amount determination unit is configured to determine an amount of the post-processing agent to be applied to the non-image area such that the glossiness of the non-image area in a case where the post-processing agent is applied to the non-image area is the determined third glossiness.

4. The post-processing agent application control device according to claim 1, wherein, the larger the glossiness difference is, the more the second post-processing agent application amount determination unit increases a number of steps in which the amount of the post-processing agent to be applied is changed from the image area to the non-image area.

5. The post-processing agent application control device according to claim 1, wherein the first post-processing agent application amount determination unit is configured to determine the amount of the post-processing agent to be applied to the image based on control information in running the post-processing agent application device.

6. The post-processing agent application control device according to claim 1, further comprising a second glossiness determination unit configured to determine the second glossiness.

7. An image forming system comprising:

an image forming apparatus configured to form an image on a recording medium;

a post-processing agent application device configured to apply a post-processing agent to the recording medium; and the post-processing agent application control device according to claim 1, the post-processing agent application control device being configured to control the application of the post-processing agent to the recording medium by the post-processing agent application device.

8. A post-processing agent application control method for controlling application of a post-processing agent to a recording medium by a post-processing agent application device, the post-processing agent application control method comprising:

determining an amount of the post-processing agent to be applied to an image that is formed on the recording medium;

determining a first glossiness that is a glossiness of a non-image area of the recording medium in a case where the determined amount of the post-processing agent is applied to the non-image area;

determining a second glossiness that is a glossiness of the non-image area of the recording medium;

comparing a glossiness difference between the determined first glossiness and the second glossiness that is the glossiness of the non-image area of the recording medium before the post-processing agent is applied, with a predetermined value; and if the glossiness difference is larger than the predetermined value, changing an amount of the post-processing agent to be applied, in a stepwise manner from an image area to the non-image area.

9. A non-transitory computer-readable recording medium including a post-processing agent application control program that causes a computer configured to control a post-processing agent application device configured to apply a post-processing agent to a recording medium, to execute:

determining an amount of the post-processing agent to be applied to an image formed on the recording medium;

determining a first glossiness that is a glossiness of a non-image area of the recording medium in a case where the determined amount of the post-processing agent is applied to the non-image area;

comparing a glossiness difference between the determined first glossiness and a second glossiness that is a glossiness of the non-image area of the recording medium, with a predetermined value; and if the glossiness difference is larger than the predetermined value, changing the amount of the post-processing agent to be applied, in a stepwise manner from an image area to the non-image area.

* * * * *